US005852235A

United States Patent [19]

Pavone et al.

[11] Patent Number: 5,852,235

[45] Date of Patent: Dec. 22, 1998

[54] METHOD AND SYSTEM FOR REAL-TIME ESTIMATION OF AT LEAST ONE PARAMETER LINKED WITH THE DISPLACEMENT OF A DRILL BIT

[75] Inventors: Didier Pavone, Ecully; Jean-Pierre Desplans, St Garmain les Corbeil, both of France

[73] Assignee: Institut Francais du Petrole, France

[21] Appl. No.: 880,801

[22] Filed: Jun. 23, 1997

[30] Foreign Application Priority Data

Jun. 24, 1996 [FR] France ..... 96 07915

[51] Int. Cl.[6] ..... E21B 45/00

[52] U.S. Cl. ..... 73/152.45; 73/152.03

[58] Field of Search ..... 73/152.03, 152.43, 73/152.44, 152.45

[56] References Cited

U.S. PATENT DOCUMENTS

| | | | |
|---|---|---|---|
| 4,794,535 | 12/1988 | Gray et al. | 73/152.44 |
| 4,845,628 | 7/1989 | Gray et al. | 73/152.44 |
| 5,305,836 | 4/1994 | Holbrook et al. | 73/152.03 |
| 5,581,024 | 12/1996 | Meyer, Jr. et al. | 73/152.03 |

FOREIGN PATENT DOCUMENTS

| | | |
|---|---|---|
| 0 289 068 | 11/1988 | European Pat. Off. . |
| 0 709 546 | 5/1996 | European Pat. Off. . |
| 2 645 205 | 10/1990 | France . |
| 2 666 845 | 3/1992 | France . |
| 2 688 026 | 9/1993 | France . |
| 2 264 562 | 9/1993 | United Kingdom . |
| 2 269 457 | 2/1994 | United Kingdom . |
| 2 270 385 | 3/1994 | United Kingdom . |

*Primary Examiner*—Max H. Noori

*Attorney, Agent, or Firm*—Millen, White, Zelano & Branigan, P.C.

[57] ABSTRACT

The present invention relates to a system and to a method designed to estimate the effective displacement of a drill bit fastened to the end of a drill string and driven into rotation in a well by surface driving means. A non-linear physical model of the drilling process based on general mechanics equations is used in the invention. The following stages are performed in the method:

the parameters of said model are identified by talking account of the parameters of said well and of said string, said model is linearized about a working point, said linearized model is reduced while keeping only some of the specific modes of the state matrix of said model, the displacement of the drill bit is computed in real time by means of the reduced model and of at least one parameter measured at the surface.

FIG. 4 to be published.

13 Claims, 4 Drawing Sheets

METHOD AND SYSTEM FOR REAL-TIME ESTIMATION OF AT LEAST ONE PARAMETER LINKED WITH THE DISPLACEMENT OF A DRILL BIT

FIELD OF THE INVENTION

The present invention relates to the field of measuring while drilling, in particular to measurements relative to the displacement of a drill bit fastened to the end of a string of drill rods. The method according to the invention proposes a solution intended to estimate notably the instantaneous rotational speed of the bit at the well bottom, said estimations being obtained by means of a computing programme taking account of the measurements performed at the top of the drill string, i.e. substantially at the ground surface, generally by means of detectors or of a sub equipped with instruments and situated in proximity to the means intended to drive the string into rotation.

BACKGROUND OF THE INVENTION

There are well-known measuring techniques intended for acquisition of data linked with the dynamic behaviour of the drill string, using an array of downhole detectors connected to the surface by an electric conductor. Document FR/92-02,273 describes the use of two arrays of measuring detectors connected by a logging type cable, one being situated at the bottom of the well, the other at the top of the drill string. However, the presence of a cable along the drill string is inconvenient for the actual drilling operations.

Documents FR-2,645,205 or FR-2,666,845 describe surface devices placed at the top of the string which determine certain drilling dysfunctionings as a function of surface measurements, but they do not take physically account of the dynamic behaviour of the string and of the drill bit in the well.

There is a drill string between the well bottom and the ground surface along which energy-dissipative phenomena (friction against the wall, torsion damping, . . . ), flexibility-conservative phenomena, notably in torsion, occur. There is thus a distortion between the downhole and the surface displacement measurements which mainly depends on the intrinsic characteristics of the string (length, stiffness, geometry), on the friction characteristics at the rods/wall interface and on contingent phenomena.

The information contained in surface measurements is therefore not sufficient by itself to solve the problem posed, i.e. to know the instantaneous displacements of the bit by knowing the instantaneous displacements of the string at the surface. The surface measurement information must be completed by independent information of a different nature which takes account of the structure of the drill string and of its behaviour between the well bottom and the surface: this is the purpose of the knowledge model that establishes theoretical relations between the bottom and the surface.

The methodology of the present invention uses the combination of such a model, defined a priori, and of surface measurements acquired in real time.

SUMMARY OF THE INVENTION

The present invention thus relates to a method intended to estimate the effective displacement of a drill bit fastened to the end of a drill string and driven into rotation in a well by surface driving means, wherein a non-linear physical model of the drilling process based on general mechanics equations is used. The following stages are performed in the method:

the parameters of said model are identified by taking account of the parameters of said well and of said string, said model is linearized around a working point, said linearized model is reduced while keeping only some of the specific modes of the state matrix of said model, the displacement of the drill bit is computed in real time by means of the reduced model and of at least one parameter measured at the surface.

The model can mainly take account of rotational displacements and said reduced model can compute in real time the instantaneous rotational speed of the drill bit, said parameter measured at the surface can be selected from at least the rotational speed of the string or the torque.

The reduced model can be fined down by means of self-adaptive filtering which minimizes the difference between a real measurement of a parameter linked with the displacement of the string at the surface and the corresponding output obtained by said reduced model.

The filtering can take account of the torque measured at the surface or of the rotational speed measured at the surface.

The invention also relates to a system intended to estimate the effective displacement of a drill bit fastened to the end of a drill string and driven into rotation in a well by surface driving means, wherein a computing unit comprises means designed for non-linear physical modelling of the drilling process based on general mechanics equations. The parameters of said modelling means are identified by taking account of the parameters of said well and of said string, and the computing unit comprises means for linearizing said model about a working point, means for reducing said linearized model so as to keep only some of the specific modes of the state matrix of said model, means for real-time computation of the displacement of the drill bit by means of the modelling means once linearized and reduced and of the means for measuring at least one parameter linked with the displacement of the string at the surface.

The modelling means may take account only of the torsion and the parameters can be the rotational speed and/or the torque.

BRIEF DESCRIPTION OF THE DRAWINGS

Other features and advantages of the present invention will be clear from reading the description hereafter given by way of non limitative example, with reference to the accompanying drawings in which.

DESCRIPTION OF THE INVENTION

Figure 1:
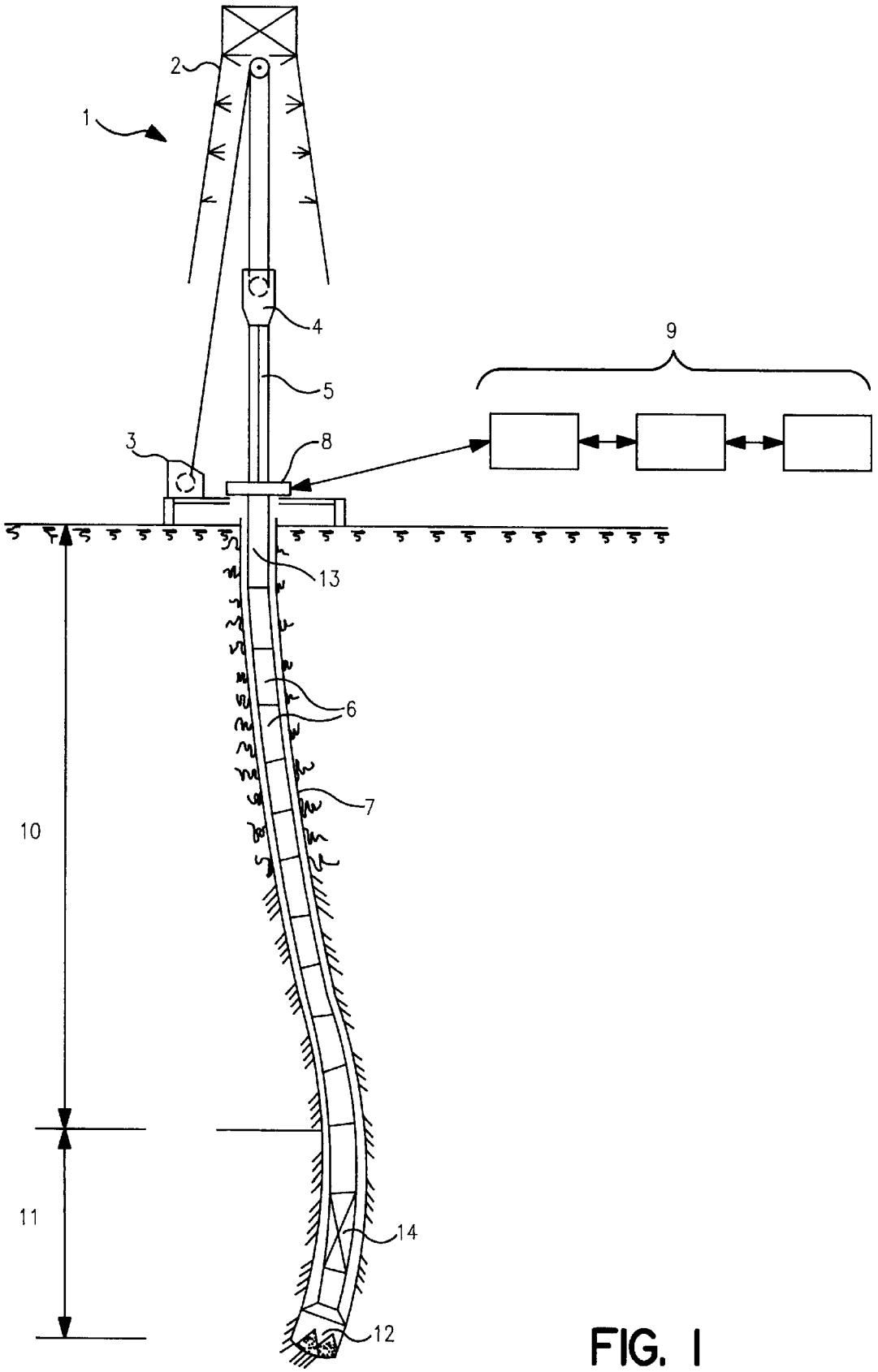
FIG. 1 diagrammatically shows the means implemented for a drilling operation.

FIG. 1 illustrates a drill rig on which the invention will be implemented.

The surface installation includes a hoisting gear 1 comprising a hoisting tower 2, a winch 3 allowing displacement of a pipe hook 4. Driving means 5 for driving the whole of the drill string 6 placed in well 7 into rotation are suspended below the pipe hook. These driving means can be of the kelly type coupled with a rotary table 8 and mechanical motive means, or of the power swivel type directly suspended from the hook and longitudinally guided in the tower.

Drill string 6 is conventionally made up of drill rods 10, of a part 11 commonly referred to as BHA (for Bottom Hole Assembly) mainly comprising drill collars, a drill bit 12 in contact with the ground during drilling. Well 7 is filled with a fluid, referred to as drilling fluid, which circulates from the surface to the bottom through the inner channel of the drill string and flows back up to the surface through the annular space between the walls of the well and the drill string.

To implement the invention, a sub 13 equipped with instruments can be interposed between the driving means and the top of the string. This sub allows to measure the torque, the rotational speed, possibly the longitudinal displacement of the top of the string. These measurements, referred to as surface measurements, are transmitted by cable or by radio to an electronic recording, processing and display unit that is not shown here. Instead of sub 13, it will be possible to use other detectors such as a tachometer on the rotary table to measure the rotational speed and a device intended to measure the torque on the motive means, if the accuracy of the measurements thus obtained is sufficient.

More precisely, the part 11 of the BHA can comprise drill collars, stabilizers, a shock absorber and a second sub 14 equipped with instruments that will be used only to experimentally control the present invention by allowing comparison between the displacement of drill bit 12 actually measured by sub 14 and the displacement estimated by implementing the present invention. It is thus clear that the application of the present invention utilizes no sub equipped with instruments and placed at the well bottom.

Three main possible actions face the driller who conducts a drilling operation with the devices described in FIG. 1, which are therefore the possible control variables allowing the drilling process to be controlled. These are the weight on bit that is adjusted through the winch controlling the position of the hook, the rotational speed of the rotary table or equivalent and the flow of drilling fluid injected.

To illustrate an example of the present invention, a model of the mechanical system made up of the following technological elements will be used:

a driving assembly: regulating device and motive means, a string of rods, a string of drill collars, a formation representing the bit/rock contact.

In the model described, the string of rods is a vertical one-dimensional element. Only rotational displacements will be taken into account, vertical and lateral displacements will be disregarded.

Figure 2:
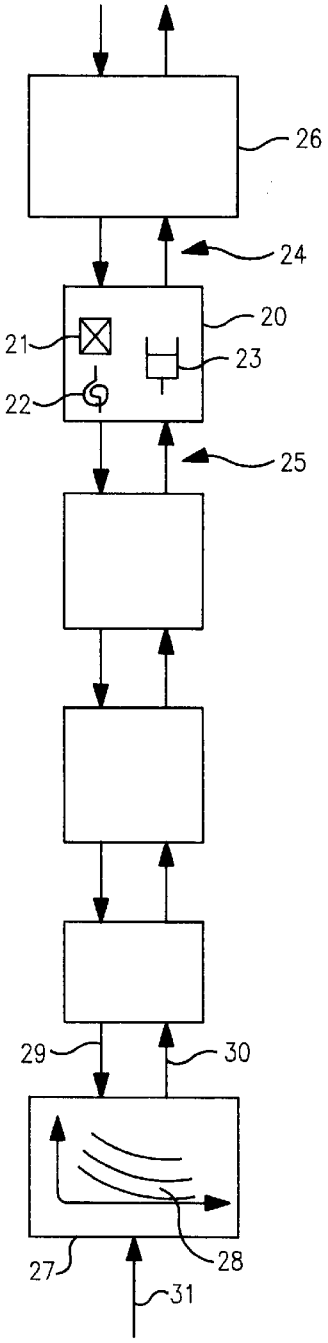
FIG. 2 is an example of a diagram of a physical model in torsion.

FIG. 2 is the block diagram of the model, which is a torsion model in the present case. This is a conventional finite-difference model which comprises several ten meshes represented by blocks 20. Each mesh represents a part of the string of rods consisting, among other things, of drill rods and drill collars. It is a mass-spring-damping triplet represented by diagrams 21, 22, 23. Each block is provided with two inputs and outputs shown by arrow pairs 24 and 25 which represent the input and output torques and the input and output rotational speeds. This representation shows how several rods (or meshes) are connected numerically as the rods of the string are connected physically.

Block 26 represents the boundary conditions at the head of the string of rods resulting from the drill rig.

Block 27 represents the friction law of the bit/formation contact determining the boundary conditions at the well bottom. It is here a resisting torque type power dissipator. The various curves 28 represent a non-linear law of the bit/rock interaction as a function of the instantaneous speed of the bit (input 29), of the resisting torque (input 29) and of the weight on bit (input 31).

This model is validated by using data recorded in the field by means of downhole and surface subs equipped with instruments.

The drilling fluid and the walls of the well are taken into account only insofar as they generate a resisting friction torque. A friction law can be established along the linear rods as a function of the rotational speed, experimentally and by using the downhole and surface measurements.

The torsion model thus obtained is generally a high-order model, i.e. of the order of 50 to 100 to reproduce the reality with sufficient fineness.

To obtain a model that can be rapidly implemented and withstands drilling condition changes, for example the change of formations crossed, the stages described hereunder are carried out.

The generally non-linear model is linearized. In the example described above, the model is linearized by selecting a working point (a rotational speed and a weight on bit) representative of the real drilling conditions. It can be checked that the behaviour of the knowledge torsional model, once linearized, is correct in the vicinity of the working point.

Linearization about a working point consists in calculating the Jacobian of the non-linear state system. The linear state system obtained is of the form $$\dot{\underline{x}}=A.\underline{x}+B.\underline{e}$$

$$\underline{s}=C.\underline{x}+D.\underline{e}$$

with:

$\underline{x}=\underline{X}-\underline{X}_0$ $\underline{X}_0$ = values of the states at the working point $\underline{e}=\underline{E}-\underline{E}_0$ $\underline{E}_0$ = values of the inputs at the working point $\underline{s}=\underline{S}-\underline{S}_0$ $\underline{S}_0$ = values of the outputs at the working point.

Conversion to the pseudo-modal form is first performed by means of a base change:

$$\underline{z}=P.\underline{x} \quad \dot{\underline{z}}=P.\underline{x}$$

After solution, we obtain:

$$\dot{\underline{z}}=P^{-1}\cdot A\cdot P\cdot \underline{z}+P^{-1}\cdot B\cdot \underline{e} \qquad \dot{\underline{z}}=\Lambda\cdot \underline{z}+B_\Lambda\cdot \underline{e}$$

$$\underline{s}=C\cdot P\cdot \underline{z}+D\cdot \underline{e} \qquad \underline{s}=C_\Lambda\cdot \underline{z}+D\cdot \underline{e}$$

P is the matrix of the eigenvectors of state matrix A,

Λ is the diagonal matrix of the eigenvalues of state matrix A.

After linearization, the torsion model keeps the same high order. Analysis of the specific modes of the torsion model allows to quantify the contribution of each mode on the noteworthy outputs. Only the pertinent modes are then retained, i.e. those having a notable influence on the dynamic behaviour represented by said outputs.

The reduced model must reproduce phenomena in a certain frequency band. The criteria of selection of the modes are thus of two different natures and they are based on observability concepts:

suppression of the modes that are not or little observable on the outputs measured, suppression of the high-frequency modes that do not enter the control or the estimator frequency band.

The reduction method used is the singular perturbation method. It consists in keeping the ligns and the columns of the state matrix and of the control matrix that correspond to the modes to be kept. To keep the static gains, the fast modes are replaced by their static value, which consequently introduces a direct matrix.

The method implies that the fast modes balance in a negligible time, i.e. they become established instantaneously (quasi-static hypothesis).

Figure 3:
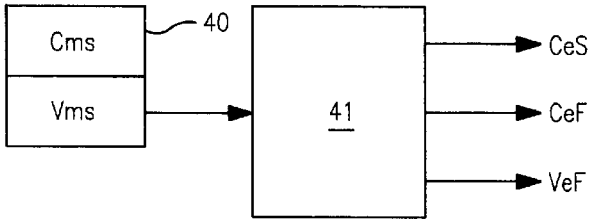
FIG. 3 shows a diagram of an open-loop estimator.

FIG. 3 shows the block diagram of an open loop type estimation system. Block 40 schematizes means for measuring surface parameters, in this case the rotational speed of the string Vms measured at the table or at the power swivel and the torque Cms also measured at the surface. Block 41 represents the reduced model which simulates the physical non-linear torsion model by computing the transfer function between the input (Vms) and the outputs Ces, Cef and Vef representing respectively the estimated surface torque, the estimated bottomhole torque and the estimated bottomhole speed.

However, the transfer function is always an approximation of reality and any mismatch between the model and the real drilling process can create a discrepancy between the estimated values and the real values by integration of the differences. It is therefore advantageous, in most cases, to perform a readjustment by means of at least one comparison between a series of values of an estimated output and the same series really measured. In this example, the linear estimator is readjusted from the surface torque.

According to the same principle, and similarly, it will be possible to enter the torque Cms measured at the surface and to readjust from the comparison between the estimated rotational speed and the rotational speed measured at the surface.

Figure 4:
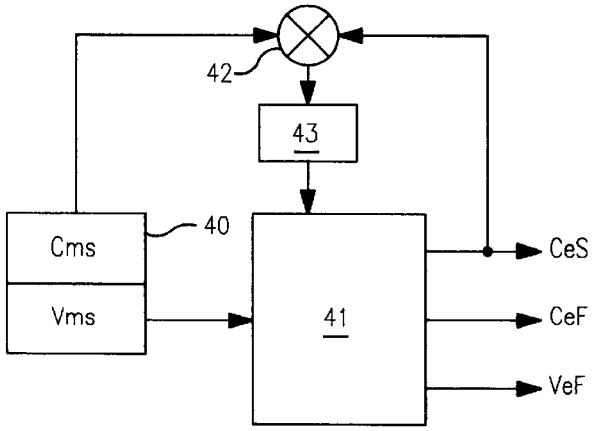
FIG. 4 shows a diagram of an estimator with readjustment, FIG. 5 diagrammatically shows the methodology of construction of the estimator according to the invention.

The estimation technique is based on Luenberger and Kalman's filtering principles ("Automatique des systèmes linéaires" by P. de Larminat and Y. Thomas—Flammarion Sciences; Paris IV, 1975). The principle of a linear estimator can be illustrated by FIG. 4 where the torque measurement Cms and the estimated value Ces are compared in means 42, the difference between these two values being injected into a real-time adapter 43. The objective here is to reconstruct the outputs as faithfully as possible rather than to have an exact model. This is the reason why a state readjustment is performed. Since the outputs are directly linked with the states, a state adjustment consists in performing a weighting between the states predicted by the model at the time t and the states reconstructed from the measured outputs only. This weighting is not a mere average, it takes account of the degree of precision of the estimations of the states obtained by two independent means. As mentioned above, the input can be the measured torque Cms and readjustment can be performed with the rotational speed.

Once the states of the model which represent the dynamics of the drilling process have been readjusted, all the outputs, measured or not, can be recomputed.

This estimation is not only interesting for non-measured variables such as Cef and Vef, it also applies to the measured variables (Cms or Vms for example) which served for readjustment. The estimated value Ces is the equivalent of a value filtered on the basis of a model, which is the reason why the term "filtering" is generally used (Luenberger filtering, Kalman filtering . . . ).

The state readjustment technique as described above introduces control of the estimated value Ces by the measured value Cms.

This looping suppresses the aforementioned risk of divergence when the model is simulated in open loop (FIG. 3).

There is thus a desensitization of the estimated variables with respect to the imperfections of the model. In this context, a perfect model is no longer required: an approximate model is enough.

Besides, only one measurement, the torque C, is available here for readjustment: it does not seem possible to readjust a large number of states from this measurement. The non-linear torsion model is therefore not suitable despite its greater precision.

A compromise thus has to be made between the precision and the order of the system. The model of minimum order which complies with the desirable precision tolerances and which is also readily adjustable and robust has to be sought.

Selection of the order of the reduced model depends on the following qualitative criteria:

the specific modes of torsional vibration which are preponderant in the outputs to be re-estimated have to be saved, for reasons of numerical coherence and stability, modes having high frequencies greater than $f_{max}=f_e/2$, where $f_3$ is the input and output sampling frequency, have to be rejected. These notions can be clarified by taking for example the case of a string made up of 800 m of 5" pipes (127 mm) and of 200 m of 8' drill collars (203.2 mm) for which the sampling frequency of the acquisition system is 10 Hz.

The modal study of the knowledge model, discretized in 35 meshes, places the first five modes at 0.344 Hz, 1.86 Hz, 3.61 Hz, 5.37 Hz, 7.12 Hz.

$f_{max}$ being equal to half of the sampling frequency, $f_{max}=5$ Hz. However, considering the possibilities of alias filters, the maximum frequency that can be observed is 2.8 Hz.

It is therefore superfluous to choose a reduced model of a higher order than 4 (two modes) if the model is to be integrated into the sampling rate fe.

Definitive selection of the reduction order can be performed by comparing the results obtained with a model reduced to order 2 and a model reduced to order 4.

Furthermore, it should be reminded that the reduced estimation model must preferably meet the real-time technological constraints.

The estimator is thus built according to the following stages:

generation of the reduced model, setting of the high-pass filters, aggregation of the high-pass filters and of the reduced model so that the set thus formed becomes the estimation model, computation of the readjustment gains, contruction of the complete estimator.

Figure 5:
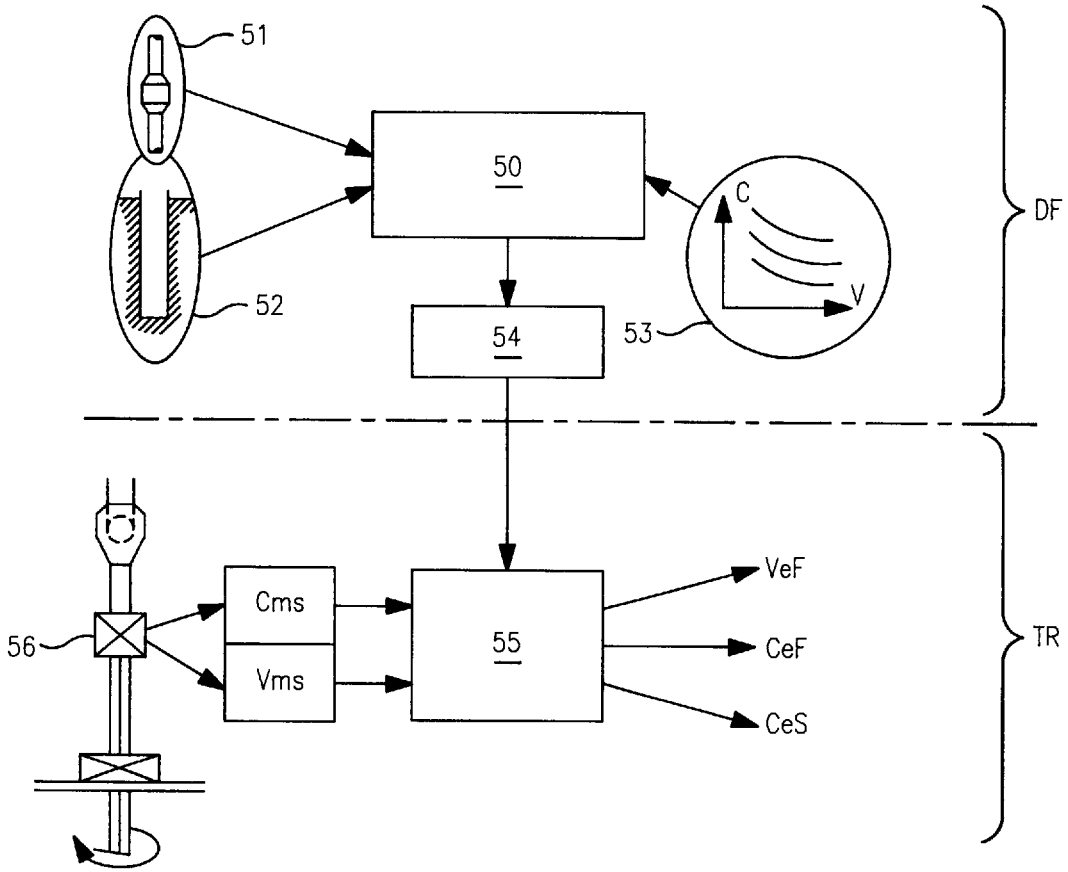

The methodology of construction of the estimator according to the invention can be illustrated by FIG. 5. Block 50 represents a physical model representing a rotary drilling process, for example illustrated by FIG. 2. This model takes account of determined operating conditions by receiving notably the mechanical characteristics of the drill string used, represented by reference number 51, the well and the surface conditions, bearing reference number 52, and friction laws bearing reference number 53. Block 54 represents the principal torsion model once linearized and reduced as described above. All these stages bracketed together under reference DF are executed off-line in relation to the course of the rotary drilling process, the other stages bracketed together under reference TR being executed in real time.

Block 55 is directly what is referred to as the estimator. Measuring means 56 situated at the top of the drill string give the torque and rotational speed measurements at the top of the rods, i.e. at the surface. These surface measurements are taken into account in the estimator, as described above, to give an estimation of the displacement values of the drill bit, in particular the rotational speed of the drill bit Vef.

The present invention is advantageously implemented on a drilling site in order to have the most precise estimation possible of the rotational speed of the drill bit in real time, from the surface measurements only, notably the rotational speed of the conventional means intended to drive the drill string into rotation, and from a surface installation equipped with electronic and computer means. It is of great significance to have an estimation of downhole parameters so as to detect and even to prevent known dysfunctionings, for example the behaviour referred to as stick-slip which is characterized by very appreciable variations in the rotational speed of the downhole bit while it is driven by means of a drill string driven into rotation from the surface at a substantially constant speed. The bit speed can range between a speed which is almost zero and a rotational speed value much above that of the speed applied at the surface. This may result in harmful effects on the life of the bits, increased mechanical fatigue of the drill string and frequent connection breakages.

Figure 6A:
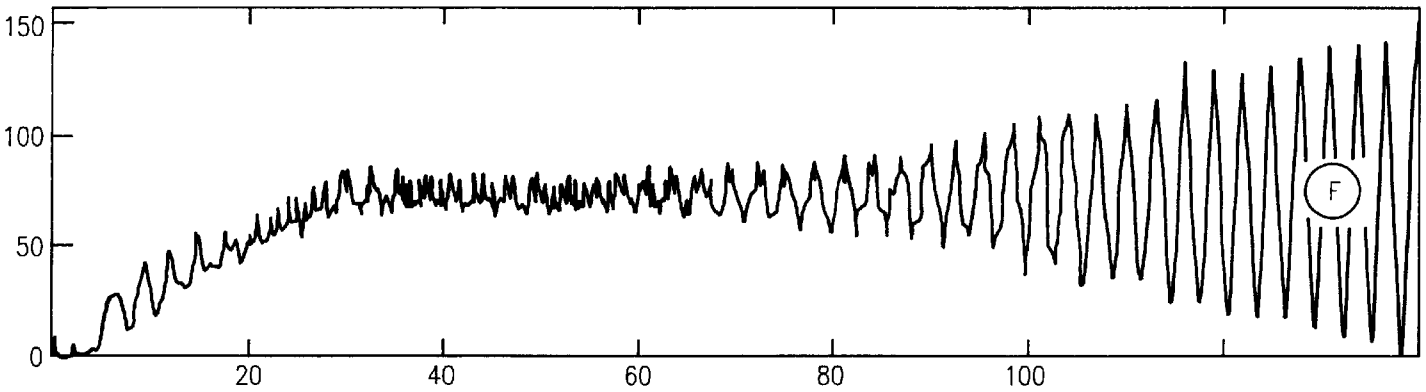
FIG. 6 illustrates the results obtained with the estimator.
Figure 6B:
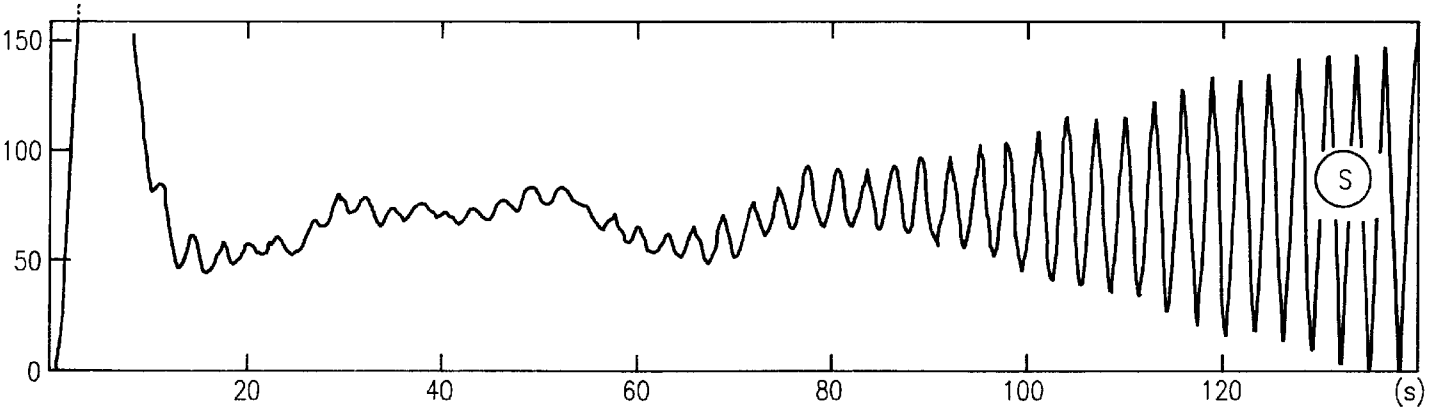

FIG. 6 shows a record F of the rotational speed of a drill bit recorded from downhole detectors, for example with the aid of the means described in document FR/92-02,273. Said means allow to perform measurements of the rotational speed and of the torque at the surface, synchronized with downhole rotational speed and torque measurements. The surface measurements are used as inputs in the estimator according to the invention and, after all the required computing stages have been carried out, the record S corresponding to the downhole bit speed estimated by the estimator according to the invention is obtained. In FIG. 6, the time is laid off as abscissa and the rotational speed of the bit is laid off as ordinate in diagrams F and S. The measurement F really performed and the values S obtained by the estimator according to the invention can thus be compared.

It is clear that the dysfunctioning referred to as stick-slip that appears at the time 80 s is distinctly estimated in diagram S, which allows the driller to be informed of the existence of this dysfunctioning by the estimator without requiring real-time bottomhole measurements. It can be seen in this figure that, between 0 and 20 seconds, there is an inaccurate estimation which is explained by the initialization of the self-adaptive filtering. This observation shows the significance of the readjustment loop.

It should also be clear that the present invention also applies to the estimation of the instantaneous rotational speed of elements included in the drill string, which can be placed at a certain distance from the drill bit.

We claim:

1. A method for estimating the instantaneous rotational speed of a drill bit fastened to the end of a drill string and driven into rotation in a well by surface driving means, wherein a non-linear physical model of the drilling process based on general mechanics equations is used, said well having physical parameters, said method comprising the steps of:

identifying parameters of said model, said parameters of said model comprising the physical parameters of said well, wherein said model is represented by a state matrix having specific modes, linearizing said model about a working point, reducing said linearized model, keeping pertinent modes of said state matrix of said model, and computing in real-time the rotational speed of the bit by means of the reduced model and of at least one parameter measured at the surface.

2. A method as claimed in claim 1, wherein said model mainly takes account of rotational displacements, and said reduced model computes in real time the instantaneous rotational speed of the drill bit, said parameter measured at the surface being selected at least from the rotational speed of the drill string or the torque measured at the surface.

3. A method as claimed in claim 1, wherein the reduced model is fined down by means of self-adaptive filtering which minimizes the difference between a real measurement of a parameter linked with the displacement of the string at the surface and the corresponding output obtained by said reduced model.

4. A method as claimed in claim 3, wherein said filtering takes account of the torque measured at the surface.

5. A method as claimed in claim 3, wherein said filtering takes account of the speed measured at the surface.

6. A system for estimating the instantaneous rotational speed of a drill bit fastened to the end of a drill string and driven into rotation in a well by surface driving means, wherein a computing unit comprises means for a non-linear physical modeling of the drilling process based on general mechanics equations and represented by a state matrix in specific modes, characterized in that parameters of said modeling means are identified by taking into account parameters of said well and of said string, in that the computing unit comprises means designed for linearization of said model about a working point, means for reducing said linearized model so as to keep pertinent modes of the state matrix of said model, means for real-time computation of the rotational speed of the drill bit or of the stress applied to the bit, by means of the modeling means once linearized and reduced, and means for measuring at least one parameter linked with the displacement of the string at the surface.

7. A system as claimed in claim 6, wherein the modelling means only take account of the torsion and wherein said parameters are the rotational speed and/or the torque.

8. A method as claimed in claim 3, wherein said model mainly takes account of rotational displacements, and said reduced model computes in real time the instantaneous rotational speed of the drill bit, said parameter measured at the surface being selected at least from the rotational speed of the drill string or the torque measured at the surface.

9. A method as claimed in claim 4, wherein said model mainly takes account of rotational displacements, and said reduced model computes in real time the instantaneous rotational speed of the drill bit, said parameter measured at the surface being selected at least from the rotational speed of the drill string or the torque measured at the surface.

10. A method as claimed in claim 5, wherein said model mainly takes account of rotational displacements, and said reduced model computes in real time the instantaneous rotational speed of the drill bit, said parameter measured at the surface being selected at least from the rotational speed of the drill string or the torque measured at the surface.

11. The method according to claim 1, where said pertinent modes are those having result-effective influence on the dynamic behavior represented by said model.

12. The method according to claim 1, further comprises the steps of suppressing the modes that are substantially unobservable on the outputs measured, and suppressing the high frequency modes that do not enter the control or the estimator frequency band.

13. The system according to claim 6, wherein the pertinent modes are those having result-effective influence on the dynamic behavior represented by said model.

* * * * *